US008308551B2

(12) United States Patent
Bennett, III et al.

(10) Patent No.: US 8,308,551 B2
(45) **Date of Patent: *Nov. 13, 2012**

(54) METHOD AND SYSTEM FOR MANAGING PROBABILITY OF AN OUTCOME IN A RANDOM GENERATION EVENT

(75) Inventors: Joseph W. Bennett, III, Sugar Hill, GA (US); Charles Holton, Reno, NV (US); Aman Safaei, Alpharetta, GA (US); Charles Boykin, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/299,662

(22) Filed: Nov. 18, 2011

(65) Prior Publication Data

US 2012/0064960 A1 Mar. 15, 2012

Related U.S. Application Data

(63) Continuation of application No. 12/534,482, filed on Aug. 3, 2009, now Pat. No. 8,083,583.

(60) Provisional application No. 61/086,024, filed on Aug. 4, 2008.

(51) Int. Cl.
*A63F 9/00* (2006.01)

(52) U.S. Cl. ..... 463/21; 463/16; 463/17; 463/18; 463/19; 463/22

(58) Field of Classification Search ..... 463/16–19, 463/21, 22

See application file for complete search history.

(56) References Cited

U.S. PATENT DOCUMENTS

| | | | |
|---|---|---|---|
| 4,652,998 | A | 3/1987 | Koza et al. |
| 5,269,523 | A | 12/1993 | Boylan et al. |
| 5,324,035 | A | 6/1994 | Morris et al. |
| 5,588,913 | A | 12/1996 | Hecht |
| 6,017,032 | A | 1/2000 | Grippo et al. |
| 6,183,361 | B1 | 2/2001 | Cummings et al. |
| 6,315,289 | B1 | 11/2001 | Sakamoto et al. |
| 6,402,614 | B1 | 6/2002 | Schneier et al. |
| 6,419,583 | B1 | 7/2002 | Crumby et al. |
| 6,585,590 | B2 | 7/2003 | Malone |
| 6,685,562 | B1 | 2/2004 | Rantanen |
| 7,399,227 | B2 | 7/2008 | Michaelson et al. |
| 7,628,691 | B2 | 12/2009 | Luciano et al. |
| 8,038,519 | B1 | 10/2011 | Luciano, Jr. |
| 2004/0185932 | A1 | 9/2004 | Lombardo |
| 2005/0064930 | A1 | 3/2005 | Jubinville et al. |
| 2006/0160602 | A1 | 7/2006 | Blythe et al. |
| 2006/0166729 | A1 | 7/2006 | Saffari et al. |

OTHER PUBLICATIONS

PCT Search Report, Nov. 3, 2009.

*Primary Examiner* — Dmitry Suhol
*Assistant Examiner* — David Duffy
(74) *Attorney, Agent, or Firm* — Dority & Manning, P.A.

(57) ABSTRACT

A lottery game system and methodology involves, for each play of the game, a player choosing a number of player indicia from a field of the indicia. A subset of the indicia is randomly generated, and the player's indicia is compared to the subset to determine a winning game play. The number of indicia in the subsets is varied between different game plays such that a blend of the winning probabilities for each subset for all of the game plays produces a desired overall winning probability.

10 Claims, 6 Drawing Sheets

Inputs

| | |
|---|---|
| slices on wheel | 20 |
| player selected slices | 4 |
| desired win frequency : 1 in ___ | 4.00 |
| Deck 1 size | 240,000 |
| ticket price | $2.00 |
| desired instant payout | 55.00% |
| Deck 2 size | 60,000 |

A

Fig. 2A

Outputs

Deck 1 Composition

| quick-picked slices | 1/win probability | # in deck |
|---|---|---|
| 4 | 4,845.00 | 0 |
| 5 | 969.00 | 0 |
| 6 | 323.00 | 0 |
| 7 | 138.43 | 0 |
| 8 | 69.21 | 0 |
| 9 | 38.45 | 0 |
| 10 | 23.07 | 0 |
| 11 | 14.68 | 0 |
| 12 | 9.79 | 0 |
| 13 | 6.78 | 0 |
| 14 | 4.84 | 101,373 |
| 15 | 3.55 | 138,627 |
| 16 | 2.66 | 0 |
| 17 | 2.04 | 0 |
| 18 | 1.58 | 0 |
| 19 | 1.25 | 0 |
| 20 | 1.00 | 0 |

B stats

| | |
|---|---|
| actual win frequency: 1 in ____ | 3.99999686 |
| required Deck 2 prize total | $263,998.00 |
| actual payout | 54.9996% |

C

Fig. 2B

METHOD AND SYSTEM FOR MANAGING PROBABILITY OF AN OUTCOME IN A RANDOM GENERATION EVENT

PRIORITY CLAIM

The present application claims priority as a Continuation Application to U.S. patent application Ser. No. 12/534,482 filed on Aug. 3, 2009 now U.S. Pat. No. 8,083,583, which claimed priority to U.S. Provisional Application Ser. No. 61/086,024, filed Aug. 4, 2008.

FIELD OF THE INVENTION

The present invention relates to a method and associated system for managing probabilities of a desired outcome in a random generation event, such as a lottery game.

BACKGROUND OF THE INVENTION

Random generation events serve as the basis for various industrial, entertainment, and gaming applications. For example, various well-known types of "online" lottery games allow a player to select one or more groups of numbers, symbols, and the like, from a defined set in the hopes of matching a group of the numbers or symbols randomly generated by the gaming administrator. For example, lottery games referred to as "Pick-3" are offered in which a player selects three numbers to match identically with a set of three numbers randomly generated by the gaming administrator at a later drawing time. Modifications and versions of this game are well known.

The probability of a particular outcome of the random generation event can be mathematically determined as a function of the total number of objects in the field and the number of randomly generated objects to be matched, and forms the basis for the parameters of any manner of probability based application, such as an online lottery game. For example, a typical lottery game is a probability based game wherein a set of numbers or other indicia selected by a player from a field of numbers are compared to a set that is randomly generated by the gaming administration from the same field to determine if the player's numbers or indicia match those in the randomly generated set. The payout for such games is typically a function of the probability of a winning play. Generally, the size of the payout for a winning play must be balanced with the probability of winning, or the quantity of numbers the player must match to produce a winning outcome. For example, when a large prize is offered, the game generally requires the player to match more numbers, as compared to a lower prize that may require a player to match only a few numbers. The games with higher prizes, however, typically produce few winners and, thus, may cause players to lose interest in the game. If the gaming administrator wishes to increase the probability of winning to produce winners more frequently by reducing the quantity of numbers a player must match for a winning outcome, the prize amount for a winning outcome is also reduced accordingly. The lower prize amount may also cause players to lose interest in the game.

Conventional online probability games thus have inherent payout fluctuations that are a factor of probabilities of winning that must be carefully considered and juggled by the gaming authority.

Instant win games are also well known and quite popular in the lottery industry. Typical instant win games are embodied by scratch-off tickets wherein the player purchases a ticket and removes an opaque security layer from the play area to instantly determine if the ticket is a winner based on any manner of game configuration. Whether or not the ticket is a winner, and the prize payout, are predetermined events. The probability of winning in an instant-win game is typically much higher than with online games, which is attractive to certain individuals. The abundance of smaller prizes is, however, unattractive to other types of players. Instant scratch-off games are desirable to the gaming authority in that the winning probability and payout percentage are predetermined and carefully managed to achieve a desired payout percentage for a particular game.

The present invention relates to a system and method of probability management that has particular usefulness in the lottery industry in that it provides for an online probability based lottery game that incorporates the probability management and payout structure benefits of instant win games.

SUMMARY OF THE INVENTION

Objects and advantages of the invention will be set forth in the following description, or may be obvious from the description, or may be learned through practice of the invention. It is intended that the invention include modifications and variations to the systems and method embodiments described herein.

The present invention provides a unique probability management methodology and related system that may have utility in any environment or application wherein it is desired to establish a particular probability of an outcome in a random generation event. In a lottery game environment, the probability management methodology may be combined with a unique payout method and system to achieve a desired payout schedule in a probability based event, such as a probability based lottery game.

Although the present probability management and payout percentage methodologies have particular usefulness with respect to management and implementation of lottery games, and are described herein by reference to lottery game embodiments, it should be appreciated that the methodologies are not limited to lottery games and may be used in any environment wherein it is desired to establish a particular outcome probability for randomly generated or seemingly randomly generated events.

In accordance with certain non-limiting embodiments of the invention, a method and system for conducting a terminal-based lottery game are provided. The lottery game includes an online instant game component, and may include an additional game component, such as a raffle component. Players purchase the associated lottery tickets at any one of a plurality of point-of-sale terminals that may be at any desired location, including various retail establishments such as convenience stores, grocery stores, gas stations, and so forth. The plurality of remote terminals are networked with a central gaming authority control computer. It should be appreciated that the central "gaming authority" may be any entity that administers or is responsible for administration of the lottery game, and may be, for example, a state or other municipal authority, a game producer, a gaming organization, and so forth.

In certain embodiments of the lottery game, an individual game play is initiated by a player completing a game slip wherein the player designates of defined number of indicia or characters, such as numbers, from a total field of the indicia presented on the game slip. For example, the player may be asked to designate a set of four numbers from a field of numbers 1 through 20 displayed on the play slip. In an alternative embodiment, the player may be provided with the option to select a "quick-play" option wherein the four numbers are randomly generated for the player by the terminal. The game slip is completed at the terminal by the player, and then scanned at the terminal. A game ticket is then issued to the player reflecting the player's designated set of numbers or characters, or the random set generated by the terminal in response to the quick-play option.

The game ticket may also immediately reflect whether the numbers or characters selected by the player, or randomly generated for the player, constitute a winning ticket based on defined game rules. The game ticket may thus instantly provide to the player an indication as to whether a prize has been won in the instant game component, as explained in greater detail below. In alternate embodiments, the winning indicia may be made known to the player at a later time.

It should be appreciated that the particular type of game is not a limiting factor. The present invention method may be applicable to any type of probability game wherein the outcome is based on some relationship between the player's selected indicia and a randomly generated set of indicia, and the probability of such outcome can be predicted or computed.

The game ticket may also provide the player with a separate game component, such as a raffle, wherein a randomly generated raffle number and instructions related to the raffle component are provided on the ticket.

In a particular embodiment, the lottery game is based on a popular theme, such as a game show theme, sports theme, entertainment theme, and the like. In a non-limiting embodiment described herein, the lottery game is based on the Wheel of Fortune™ game show. In this embodiment, play of the instant lottery game is initiated by a paying player submitting a game slip that designates a set of characters that correspond to positions around a game wheel depicted on the game ticket. Alternatively, the player may select the quick-play option wherein the set of characters is randomly generated for the player. Each position on the game wheel has a designated value, and a winning event occurs when a predefined combination of the player's selected positions (or randomly generated positions) have the same value, with the player winning this value. For example, the game may require that all, or less than all, of the player designated characters have the same value, with a greater prize awarded for a higher number of matches. A prize may be awarded for subsets of at least two matches, with different values being possible between different subsets. It should be appreciated that various combinations of prize structures, and the presentation thereof, are possible within the scope and spirit of the invention.

A particularly beneficial aspect of an online instant lottery game incorporating the technical features disclosed herein is that the unique probability management system allows the gaming authority to establish an overall probability of winning and associated payout schedule that are similar to scratch-off instant lottery games without eliminating the desirable aspects of an inherent probability game that allows players to select their play indicia from a field of indicia. The method involves defining a subset to have a number ("X") of the indicia from the total field, and then randomly generating the subset with the X number of indicia. The player's selected indicia are then compared to the subset of indicia to determine if the player's selection is a winner according to the defined game rules. For example, the game may require that all of the player's indicia are contained (i.e., "matched") in the subset for a winning game play. In alternative embodiments, a lesser prize may be awarded for a lesser number of matches. Prizes may be awarded for subsets of matches, and so forth.

Generation of the random subset from the total field of indicia occurs for each game play, and the number X of indicia in the subsets may vary between plays. For example, in one particular embodiment of this process, a first game play may result in generation of a first subset having a first number ("X1") of indicia, and the second game play may result in generation of a second subset having a second different number ("X2") of indicia, and so forth. Based on a total number of game plays, the number X of indicia in the subsets may be varied between different plays, wherein each number X generates a unique probability of winning. In this way, the gaming authority can compute a blend of subsets for the course of the game having different numbers (X1, X2, X3, . . . ) of indicia to achieve a desired overall winning probability for all of the game plays. The number X of indicia in the respective subsets is less than the number of indicia in the total field, and the number of player indicia is less than the number X of indicia in the subsets. Different combinations of these variables are also within the scope and spirit of the invention.

Once all of the game plays have been played or otherwise exhausted for the generated blend of subsets, the subsets may be recycled (with or without shuffling) for continuation of the game, or a new game may be implemented under the same procedures.

In a unique embodiment, the prize structure for all of the winning game plays is randomly generated by the gaming authority to achieve a desired payout schedule as a function of the designed winning probability and overall number of anticipated plays of the game. For example, the designed winning probability for the game may be 1 in 4, based on a total of 100,000 plays of the game. In this situation, the gaming authority may assign a payout to each of the expected 25,000 winning game plays that achieves a desired overall payout percentage over the course of 100,000 plays. The payout schedule can be tailored to the prize structure for any game. For example, the prize structure for a game having only one possible winning combination (e.g., all of the player's indicia must be matched in the subset) will be different from the prize structure wherein multiple winning combinations are possible (e.g., 2 of 4, or 3 of 4 matches are awarded lesser prize amounts). One method for implementing this payout schedule is discussed in greater detail herein.

One method for establishing the desired overall winning probability may be implemented by establishing a first "deck" containing at least two sets of "records"; a first set of the records designating a first number X1 of indicia in the subsets, and a second set of the records designating a second number X2 of indicia in the subsets. It is to be understood that the term "deck" is used herein to connote any manner of compilation or set of items. The term "record" is used herein to connote any manner of file, value, data point, and the like. Thus, in one embodiment, a "deck" of "records" may refer to a computer generated file that defines distinct values X, wherein each of the values is later retrieved and used to generate a subset from the total field of indicia having the defined number X of indicia. In an alternate embodiment, the actual subsets having the defined number X of indicia may be randomly generated and stored as a component of the records, thus eliminating the step for subsequent random generation of the subsets. The number of records in the first set with number X1, and number of records in the second set with number X2, are computed to achieve the desired overall winning probability for the game based on a designated number of game plays.

It should be appreciated that the first deck may include additional sets of records. For example the first deck may include a third set of the records having a third number X3 of indicia, and a fourth set of the records having the number X4 of indicia, wherein the blend of the four sets of numbers achieves the overall desired winning probability for the game.

The records in the first deck may be assigned to the individual game plays by various methods. In one embodiment, the records are initially generated for the total number of game plays, randomly shuffled, and stored. The records are then assigned sequentially to each individual game play.

The number of records in the first deck will generally be based on a theoretical number of total game plays, for example, 200,000 game plays. The total number of game plays is defined by the gaming authority to achieve a close approximation to the desired overall win probability. A greater number of games allows for a closer approximation to the win probability. The total number of records in the first deck will generally correspond to the total number of game plays.

It should be appreciated that the invention encompasses any manner of gaming method that implements the unique probability management system, and that such methods may or may not include features related to the payout percentage methodology described herein.

In certain embodiments, a step of assigning a payout to each winning game play is provided as a function of a predefined overall percentage payout. This feature provides the gaming authority with the ability to achieve a closely controlled payout percentage similar to a scratch-off instant lottery game. This may be accomplished by establishing a second deck of records, with the number of records in the second deck corresponding generally to the expected number of winning game plays as a function of the overall winning probability of the game. Each of the records in the second deck designates a prize payout such that a totality of the payouts corresponds to the desired percentage payout schedule as a function of the prize structure for the particular game. One of the records in the second deck is assigned to each of the game plays designated as a winning game play. The records in the second may be assigned a payout value, randomly shuffled, and then assigned sequentially to the respective winning game plays.

As mentioned, it may be desirable to include an additional game component with each lottery ticket, such as a raffle component. In such embodiments, a raffle number is randomly generated and assigned to each ticket to be used in a subsequent raffle drawing. The raffle drawing includes all assigned raffle numbers issued for a given time period prior to the raffle. In this way, a winner is guaranteed in the raffle drawing.

The raffle may be conducted in conjunction with an independent third party event. This third party event may be any event that is unrestrained by the lottery and that awards a prize that is independent of the lottery. A typical third party event may be, for example, a contest or game wherein contestants compete for an award. The lottery raffle prize may be designated at a fixed amount prior to the raffle, or may be a function of the winning contestant's award. For example, the raffle prize may have a value equivalent to the value of the contestant's award, or may have an increased value based on a multiplication of the winning contestant's award.

In a unique embodiment, the independent third party event is a televised game show. Game shows such as the Wheel of Fortune™ or The Price is Right™ have a vast following of viewers, and lottery games affiliated with or licensed by the game shows will have great appeal to these viewers. In this regard, the instant lottery game component may have a theme based on the game show, and the raffle component prize is based on the winnings of the game show contestant. The raffle drawing can be conducted in conjunction with the game show, and may be, for example, televised prior to, during, or immediately after the game show. Alternatively, the raffle may be conducted by the gaming authority at a later time. The lottery ticket will instruct the players as to the particular date and time of the game show that determines the raffle prize, and may also provide the time and date of the raffle drawing. With this unique interaction between the lottery game and the game show, the game show is also promoted via the lottery game in that lottery ticket purchasers are encouraged to view the televised game shows.

With many known televised game shows, the prize awarded to the winning contestant may be any combination of cash, merchandise, or other items. In this event, the raffle prize may have a cash value that is at least equivalent to the value of the prize or prizes won by the game show contestant.

The present invention also encompasses computer-implemented methods of conducting a probability-based lottery game with a computer system having instruction files to implement the lottery game. In certain embodiments, for each play of the lottery game, the method provides for a player to choose a number of player indicia from a total field of the indicia, wherein the player indicia is compared to a randomly generated subset of X number of indicia from the total field of the indicia to determine whether the game play is a winning play. A desired overall winning probability is established for the game plays by varying the number X of indicia in the subsets between different game plays such that a blend of the winning probabilities for each number X for all of the game plays produces the desired overall winning probability.

In particular embodiments, the number X of indicia in the subsets is less than the number of indicia in the total field, and the number of player indicia is less than the number X of indicia in the subsets.

The step of establishing the desired overall winning probability may include establishing a deck of indicia subset records containing a plurality of sets of records (X1, X2, . . . ) that designate a respective number (X1, X2, . . . ) of indicia in the subsets. The blend of different sets of records having different X numbers is computed to achieve the overall desired winning probability for the game. In a certain embodiment, the records in the first deck may be randomly shuffled and assigned sequentially to each game play. The total number of records in the first deck may correspond to the total number of game plays designated for the lottery game.

The method embodiments may further include assigning a payout to each winning game play as a function of a predefined overall percentage payout for the game and the overall winning probability such that the payout for all expected winning game plays achieves the percentage payout. The step of assigning a payout to each winning game play may include establishing a deck of payout records, with the number of records in the payout deck corresponding to the expected number of winning game plays as a function of the overall winning probability of the game. Each of the records in the payout deck designate a prize payout such that a totality of the payouts corresponds to the desired percentage payout schedule, and one of the records in the payout deck is assigned to each of the game plays designated as a winning game play. The records in the payout deck may be randomly shuffled and assigned sequentially to the winning game plays.

In other embodiments, the game includes multiple winning game play combinations, and the method includes establishing additional payout decks for each combination, and distributing the prize payout over all of the payout decks so as to achieve the desired percentage payout schedule for all of the possible winning combinations.

Other objects and advantages of the method and system of the present invention may become apparent to those skilled in the art through practice of the invention.

BRIEF DESCRIPTION OF THE DRAWINGS

FIGS. 2A and 2*b* are tables with representative inputs and outputs to a probability management method for an online lottery game depicted in FIGS. 1A and 1B having an overall winning probability of 1 in 4.

DETAILED DESCRIPTION

Reference will now be made to one or more embodiments of the system and methodology of the invention as illustrated in the figures. It should be appreciated that each embodiment is presented by way of explanation of aspects of the invention, and is not meant as a limitation of the invention. For example, features illustrated or described as part of one embodiment may be used with another embodiment to yield still a further embodiment. It is intended that the invention include these and other modifications that come within the scope and spirit of the invention.

The figures depict the unique probability management and payout percentage methods implemented for an online instant lottery game. As explained above, the invention is not limited to lottery game applications, and includes use in any environment wherein the benefits of the invention are applicable. With respect to lottery games, the invention is not limited to any particular type of lottery game. It should be appreciated that lottery game embodiment provided herein is for illustrative purposes only.

Figure 1A:
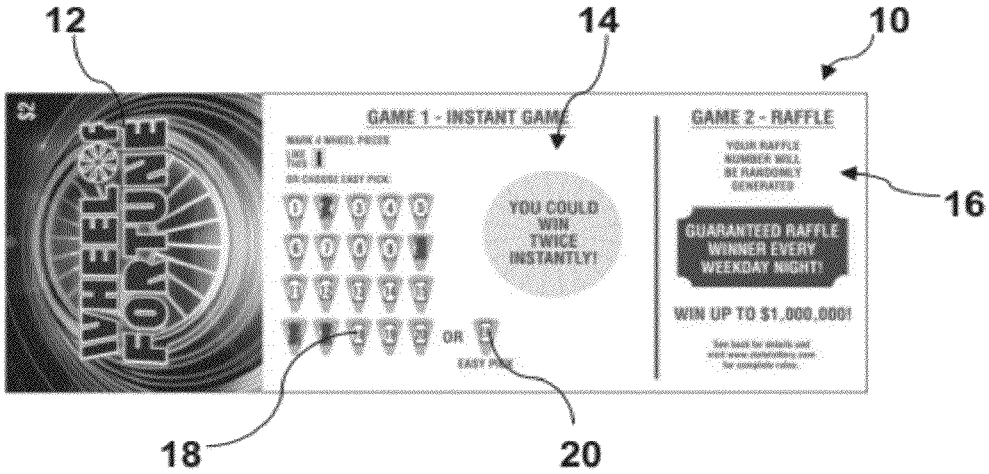
FIG. 1A is a perspective view of a game slip that may be used by a player to initiate play of an embodiment of a lottery game in accordance with aspects of the invention.
Figure 1B:
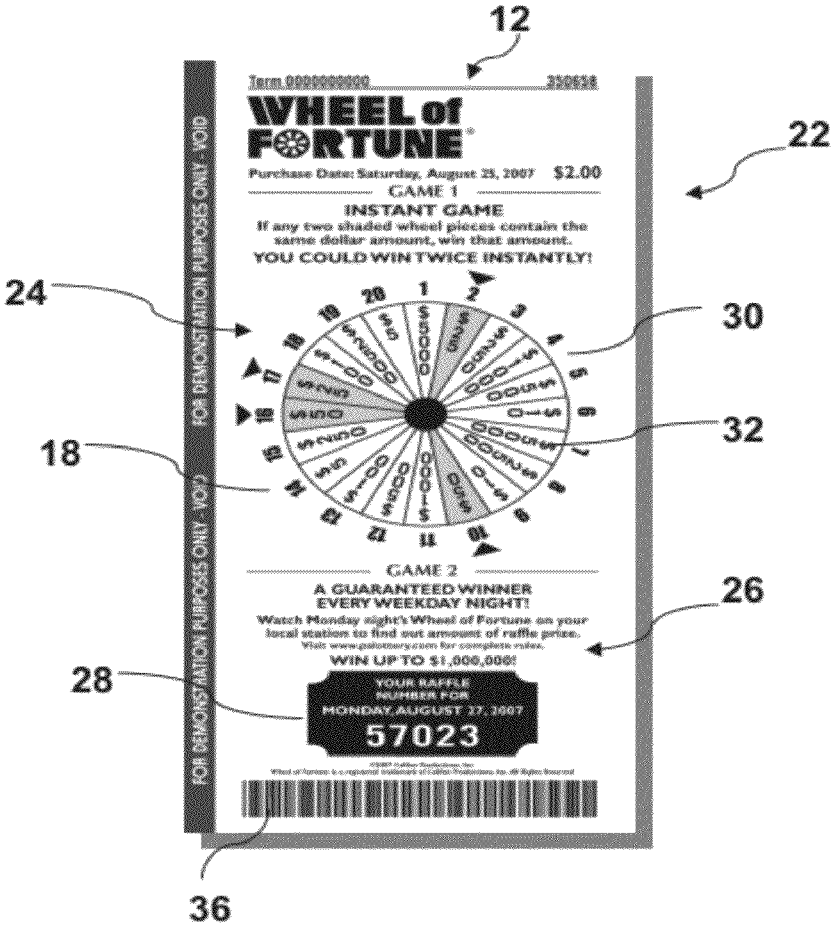
FIG. 1B is a perspective view of a lottery ticket that may be used in play of an embodiment of a lottery game in accordance with aspects of the invention.

Referring to FIGS. 1A and 1B, an embodiment of an online instant win lottery game may be initiated at lottery terminal locations provided by a gaming authority by players paying a fee and completing a game slip 10. Referring to FIG. 1A, the game slip 10 may include any manner of indicia 12 that identifies the game with a particular theme, such as poker, or an affiliated/licensed game show, sports team or event, and so forth. For embodiments that include an additional game component, the game slip 10 may include a region related to the respective component. Area 14 is the player's selection area for the instant online lottery game, wherein the player is asked to designate their selection of indicia from a total field of the indicia. For example, in the illustrated embodiment, the player designates four numbers from the total field of twenty numbers. Alternatively, the player may select the quick-play option 20 wherein the set of our numbers will be randomly selected by the terminal for the player.

An additional game area 16 informs the player of the existence of the additional game component and provides the player with information and instructions related to the additional game.

At a lottery terminal location, the game slip 10 is scanned and a game ticket 22 (FIG. 1B) is generated. The game ticket 22 includes the same or different indicia 12 related to the game theme, as well as an instant game play area 24, and an additional game area 26 if an additional game component is offered. The instant game play area 24 presents the results of the instant lottery game to the player in a manner consistent with defined game rules and the game theme. For example, in the illustrated embodiment, a wheel 30 is depicted. This wheel 30 is widely recognized as symbolic of the Wheel of Fortune™ television game. The wheel 30 includes distinct positions 32, with each position 32 having a cash value designated therein. The total field of indicia or numbers (in this case, twenty numbers) presented on the game slip 14 are located around the wheel 30, with each number associated with a given wheel position 32. The game ticket 22 visibly indicates the set of numbers either selected by the player via the game slip 10, or randomly generated for the player. For example, in the illustrated embodiment, the player selected numbers 2, 10, 16, and 17 via the game slip 10. These selections are indicated on the game ticket 22 by arrows and/or by corresponding shading of the associated wheel positions 32. Players can readily determine whether they have won by simply examining the shaded or marked wheel positions 32.

An indication may be provided on the ticket 22 to indicate a winning game play in accordance with the game rules. For example, the game may provide that, if any two shaded or marked wheel positions 22 contain the same dollar amount, the player wins that dollar amount, as in the illustrated embodiment wherein $25.00 appears in two of the four shaded wheel positions 32. Thus, the player wins $25.00. Because four positions are selected by the player, it is possible that the player can win twice in the instant game lottery component. For example, in the game ticket 22 shown in FIG. 1B, positions 16 and 10 indicate $50.00. Thus, the player wins $50.00 in addition to the $25.00 indicated by positions 2 and 17, for a total of $75.00.

In an alternate embodiment of the game illustrated in FIGS. 1A and 1B, the game rules may require that all four of the player's selected positions contain the same dollar amount for a winning game play. In still alternate embodiments, lesser prize awards may be made for three of four, or two of four matches, and so forth.

For each game ticket 22 generated, the relative location of the characters 18 around the wheel 30 represents a random generation event wherein a set of the indicia is randomly generated from a total field of the indicia and compared to the player's selected indicia. The manner of presenting the results of this event may vary widely between different types of games. For example, in the illustrated embodiment of FIGS. 1A and 1B, the premise of the game is that the player picks four numbers from the field of one to twenty numbers, and the game randomly generates four numbers from the same field. If some combination of the player's selected numbers match or relate to the randomly generated set of numbers according to the game rules, then is the play is a winning game play. FIG. 1B is a representation that all four of the player's selected numbers were matched by the randomly generated set, with the dollar amounts provided at each wheel position to indicate the prize award.

Thus, the basic play action for the online instant-win may be summarized as follows: a player designates their choice of indicia or characters, such as numbers, from a total field of the indicia or characters. For example, the player may be asked to designate a set of 4 numbers from a field of numbers 1 through 20. In an alternative embodiment, the player may be provided with the option to select a "quick-play" option wherein the 4 numbers are randomly generated from the total field for the player by the terminal. A game ticket is issued to the player that reflects the player's selection of indicia, and also reflects a randomly generated set of indicia derived from the total field of indicia in accordance with the probability management method. If the player's selected indicia are contained in, or otherwise relate to the randomly generated set according to the game rules, then the game play is a winning play. This is a probability based game, and the invention provides a methodology designed to minimize payout fluctuations inherent in such probability based games. Aspects of the probability management system and methodology are explained by reference to FIGS. 2A, 2B, and 3, as set forth below.

FIG. 2A presents a table of representative inputs for the probability management method. For example, in the Wheel of Fortune™ game illustrated in the play slip and ticket of FIGS. 1A and 1B, there are 20 slices or wedges on the wheel 30. Thus, in this particular game, the total field of indicia has 20 objects. The player selects 4 of the wedges on the wheel. The gaming authority has designated a desired overall probability of winning in the game of 1 in 4 based on a total of 240,000 individual game plays. A ticket price may also be designated, such as $2.00, $5.00, and so forth. The gaming authority may also designate a desired percentage payout schedule for the instant online game. In the illustrated embodiment, this payout percentage is 55%.

The table B in FIG. 2B represents the outputs of the probability management method for this particular game that results in generation of the first deck for a game of 240,000 individual game plays. The first two columns in table B illustrate the various win probabilities. For example, if a player were to randomly pick 4 numbers from the field of 1 to 20 numbers, and the system were to randomly generate a subset having X number of indicia from the total field of indicia of 1 to 20, the various win probabilities are provided. For example, if the subset contains 14 of the indicia (X=14), then the odds that the player's 4 selected indicia match the subset of 14 randomly generated indicia is 1 in 4.84. Similarly, for a subset of 15 of the indicia (X=15), then the probability that the player's 4 selected indicia are contained in the subset is 1 in 3.55. Those skilled in the art of computing probabilities recognize that the probabilities may be determined according to the following relationship:

$$\frac{\binom{x}{4}}{\binom{20}{4}} \text{ or } \frac{combin(x, 4)}{combin(20, 4)}$$

Thus, it should be appreciated that a blend of records in the first deck having different probabilities may be computed to achieve an approximate overall win probability of for example; 1 in 4. In other words, the first deck can include different sets of records having numbers X1, X2, X3, . . . wherein each of the X numbers has a different probability of winning. In the illustrated embodiment, the deck is generated based on a total of 240,000 game plays and includes 101,373 records with X1 equal to 14 indicia (probability of winning of 1 in 4.84), and 138,627 records with X2 equal to 15 (probability of winning of 1 in 3.55). The blend of these records results in an overall probability of winning of 1 in 3.99999686 (Table C), which closely approximates the overall win probability of 1 in 4. The number of records having different X numbers may be determined by the following relationship:

$$\frac{(n \times p1 + (s - n) \times p2)}{s} = pd$$

or $$n = sx(pd - p2)/(p1 - p2)$$

Where:

$S$ = Total Deck Size (No. of Records)

$P_1$ = Probability when Lottery chooses $X_1$ numbers $P_2$ = Probability when Lottery chooses $X_2$ numbers $n$ = Number of cards in deck with $X_1$ $P_d$ = Desired probability Table B in FIG. 2B represents an embodiment wherein the first deck contains two sets of records, with the first set of records designating a first number X1 equal to 14, and a second set of records designating a second number X2 equal to 15, with the blend of the different sets of records having different X numbers achieving the overall desired winning probability that closely approximates 1 in 4 (1 in 3.99999686). In alternative embodiments, the first deck may include additional sets having different numbers, X3, X4, and so forth. For example, the first deck may include a third set of records having a third number X3 equal to 13, and a fourth set of records having a number X4 equal to 16. Again, the number of records in each set is computed such that the total blend of records produces the overall win probability of 1 in 4 for all of the contemplated game plays.

Figure 3:
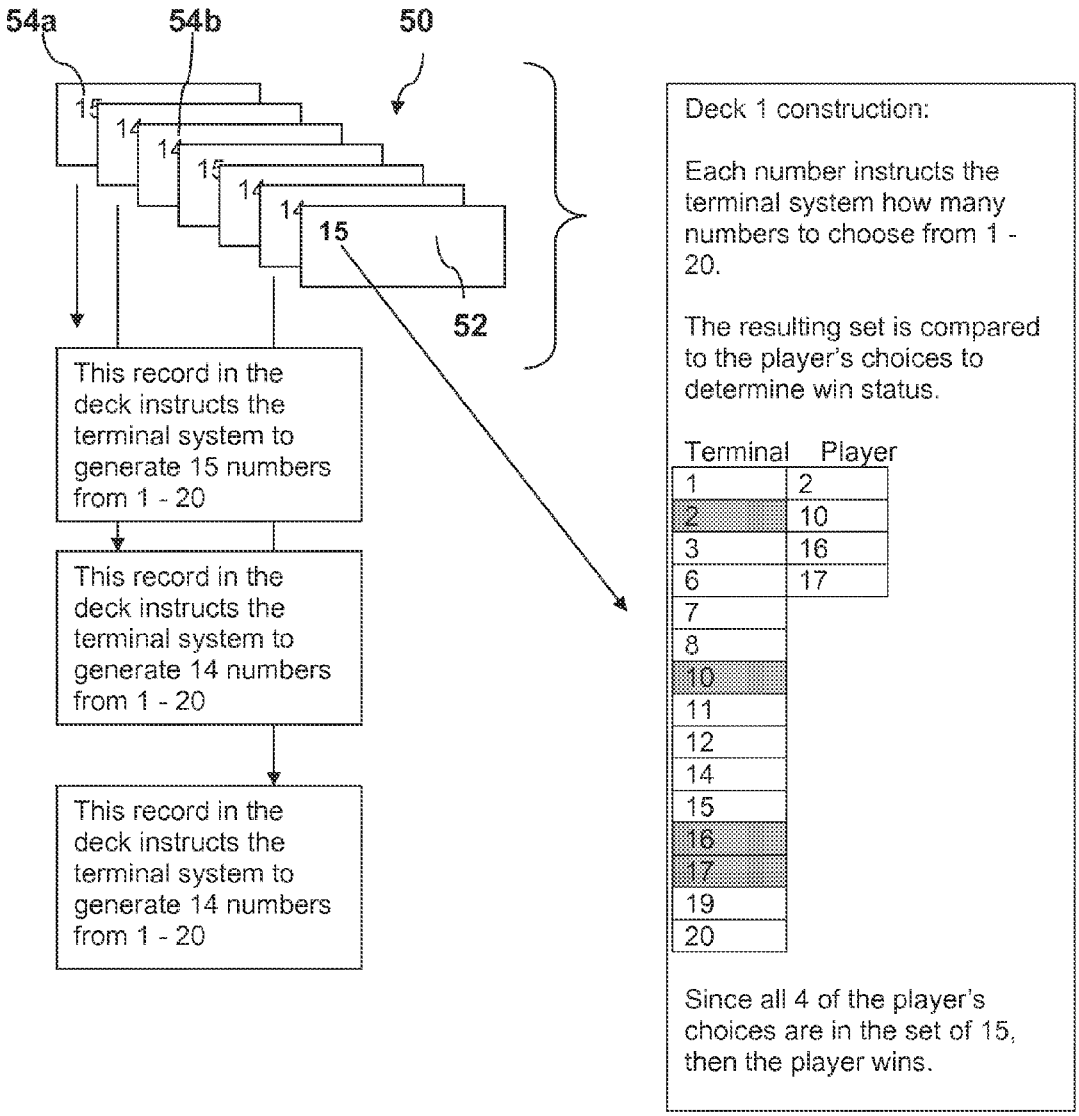
FIG. 3 is an operational chart illustrating use of a first deck of records for achieving a defined overall winning probability with the probability management system represented in FIGS. 2A and 2B.

FIG. 3 further illustrates an embodiment of the probability management methodology. The first deck is represented by the compilation 50 and includes individual records 52. Each record 52 designates an X value 54*a*, 54*b*, and so forth. In the illustrated embodiment, deck 50 includes a first subset having numbers X1 equal to 14, and a second subset having numbers X2 equal to 15. Every game play is assigned one of the records, and the respective X number dictates to the terminal system how many numbers to randomly generate from the total field of the numbers 1 through 20 for the respective game play. In an alternate embodiment, the step of randomly generating the X number of indicia for each record may be done at the time of generating the records, such that each record contains the respective X number of randomly generated numbers from the total field of numbers. In this scenario, the terminal system simply retrieves a record for each game play and uses the subset of indicia that was previously randomly generated and associated with the respective record.

In the illustrated embodiment, the records are assigned sequentially to each individual game play. Thus, the first record in the deck 50 instructs the terminal system to generate 15 numbers from the field of numbers 1 through 20 for the first game play, or use the 15 numbers previously generated and stored with the record. The second record instructs the system to generate 14 numbers from the total field of numbers 1 through 20 for the second game play, and so forth.

Still referring to FIG. 3, the resulting subset of numbers for each of the game plays is compared with the player's selected numbers to determine whether the game play is a winning play according to the defined game rules. In the illustrated embodiment, the players 4 selected numbers are 2, 10, 16, and 17. The next sequential record 52 in the deck 50 resulted in generation or retrieval of 15 different numbers randomly generated from the total field of numbers 1 through 20, as illustrated in the chart in FIG. 3. The player's 4 selected numbers are contained within the subset of 15 numbers. Thus, this particular game play is a winning game play. The game rules may define that a lesser number of matches, such as 3 of 4, or 2 of 4, result in a winning game play, but for a lesser prize amount.

In the illustrated embodiment, the individual records in the first deck 50 are generated, randomly shuffled, and then assigned sequentially to respective game plays. In alternative embodiments, assignment of the individual records may also be conducted randomly.

Thus, it should be appreciated that for a given number of game plays (i.e. 240,000 individual game plays), a desired overall win probability can be established by varying the number of randomly generated indicia within the subsets of the different game plays. A theoretical total number of game plays is defined by the gaming authority to achieve a dose approximation to the desired overall win probability. A greater number of games allows for a closer approximation to the win probability. An individual game play will have a win probability defined by its individual X number. For example, a first player may have a win probability that may be the same as or varies as compared to subsequent players, and so forth. However, the number of game plays having different win probabilities is computed such that the win probability considering all of the game plays achieves a desired overall win probability and on average equalizes the odds over time. This feature is not apparent to the individual players in that a player cannot determine the X number for the subset used in any particular game play.

Thus, the gaming authority can establish an online instant win game having an overall win probability dictated by the gaming authority for the totality of the game plays. Once the first deck has been depleted, or otherwise exhausted, the gaming authority may simply recycle the deck to continue play of the game. The recycled deck may be used in the first sequential order, or may be reshuffled. Alternatively, the gaming authority may compute an entirely different deck. This process is also seamless and invisible to the players.

Figure 4:
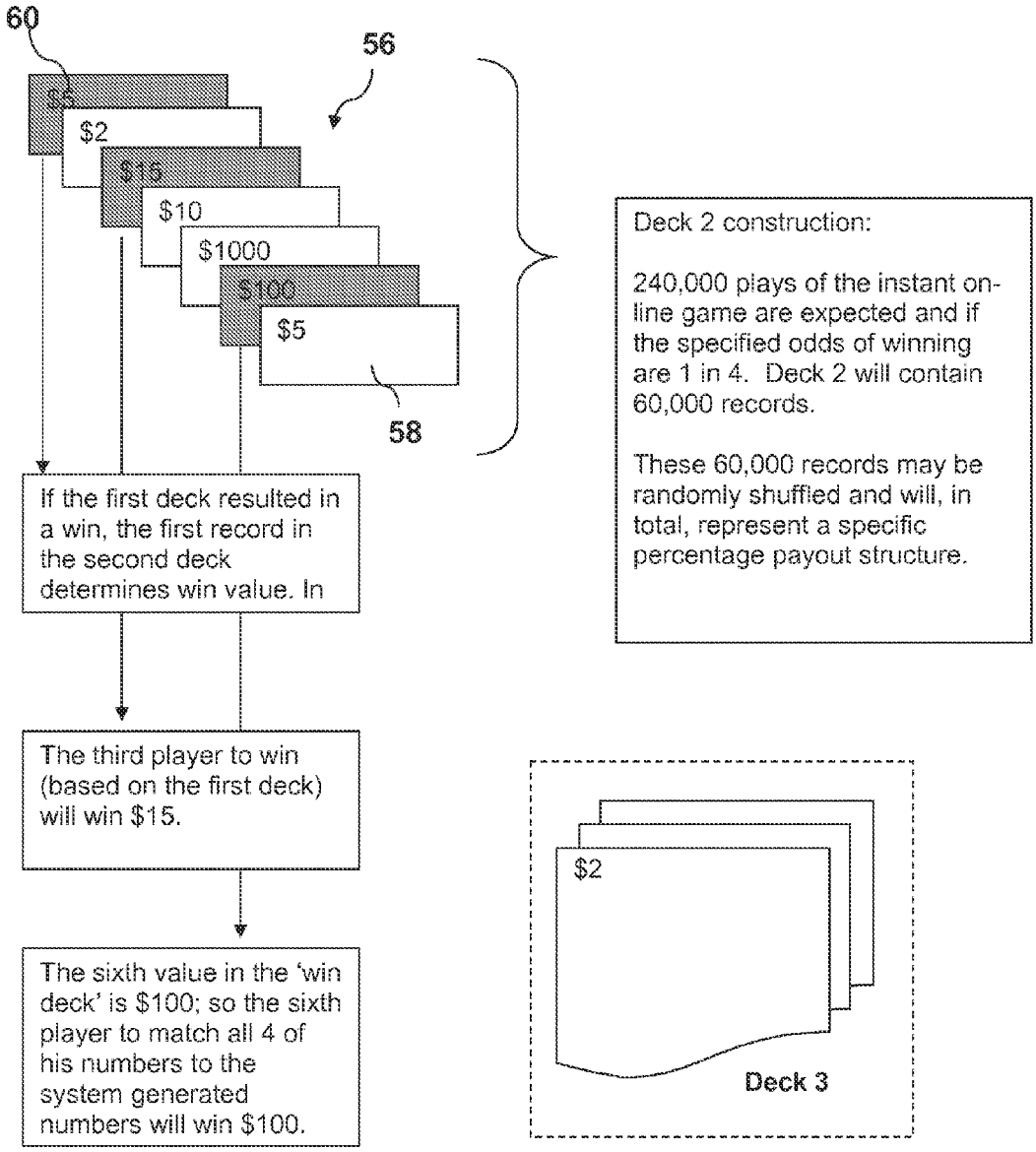
FIG. 4 is an operational chart illustrating use of a second deck of records to achieve a desired percentage payout structure for an online instant lottery game.

The probability management method also allows the gaming authority to achieve a desired payout schedule for the totality of the individual games. Referring to FIG. 4, this feature may be accomplished by establishing a second deck 56 of individual records 58, with each record 58 designating a prize payout value 60. The number of individual records 58 within the second deck 56 is computed as a function of the total number of game plays used to define the first deck and specified overall win probability. For example, referring to FIG. 4, if 240,000 plays of the instant online game were contemplated for the first deck, as discussed above with respect to deck 1 in FIG. 3, then approximately 1 in 4 of the individual game plays will be a winning play. In other words, approximately 60,000 of the game plays will be winning plays. Thus, deck 2 is configured to contain 60,000 records.

A prize payout value 60 is assigned to each of the records 58 such that the total sum of the values 60 corresponds to a desired percentage payout. For example, referring to FIGS. 2A and 2B wherein 240,000 individual game plays are contemplated at a ticket price of $2.00 for each game play, the gaming authority may designate a percentage payout of 55% for the totality of the game. This payout percentage may be achieved by assigning a combination of prize payout values to the individual records 58 in deck 2. Referring to FIG. 4, for example, the deck 56 may include records 58 indicating a payout value 60 of $5.00, $2.00, $15.00, $10.00, $1000.00, $100,00, and so forth. Various combinations of records having different payout values are obviously available to achieve the total payout value corresponding to the desired percentage payout of 55%.

After the records 58 are generated, they may be randomly shuffled and applied sequentially to each winning game play. For example, referring to FIG. 4, the first record 58 in the deck 56 is applied to the first winning game play from the deck 50 of FIG. 3 so that this winning game play has a payout value of $5.00. The third winning game play (based on the first deck 50) wins $15.00. The sixth winning game play from the first deck wins $100.00, and so forth.

Thus, by managing the probability of winning over the course of the game as described above, the gaming authority can closely approximate the number of game plays that will be winning plays. A desired payout percentage schedule may then be readily applied to this known number of winning plays to achieve designated overall win probability and precisely controlled payout schedule.

It should be appreciated that the above methodology may be readily tailored for probability games that include multiple winning combinations. For example, in the game illustrated above, the game rules may define that 3 of 4, or 2 of 4, matches between the player's selected numbers and the randomly generated set of 4 numbers also results in a winning game play, but for a lesser prize amount as compared to 4 of 4 matches. The above methodology may be used to compute respective second prize decks associated with the lesser prize structures, as graphically illustrated as "Deck 3" in FIG. 4. For example, in the above described game, the gaming authority can readily predict the number of game plays having 3 of 4 matches, or 2 of 4 matches, and can generate a respective second prize deck for each scenario that has a number of records corresponding to the predicted number of winning game plays for each respective prize structure. Each of these records may include a prize award, with the records being assigned sequentially to winning game plays having 3 of 4 matches, or 2 of 4 matches, and so forth.

Distribution of the prize money between the various second decks is done to achieve the overall desired payout percentage. In other words, if the game rules define that a winning game play must include 4 of 4 matches, then the entire amount of prize money as a function of the designed payout percentage is distributed over a single second deck, as in the embodiment of FIG. 4 above. If the game rules define that a lesser number of matches also win a lesser prize award, then some amount of the prize money is distributed over an additional second deck generated for the lesser prize structure. The prize amounts may vary within a range for each deck. For example, the prize award for 4 of 4 matches may vary between $2 and $1,000, as in FIG. 4, and the prize award for 3 of 4 matches may vary between $2 and $100. The prize award for 2 of 4 matches may vary between $2 and $10.

The lottery terminal can be readily configured to compare the player's selected indicia to the randomly generated indicia, and determine and display the winning prize amount on the game ticket 22 according to the game rules.

Figure 5:
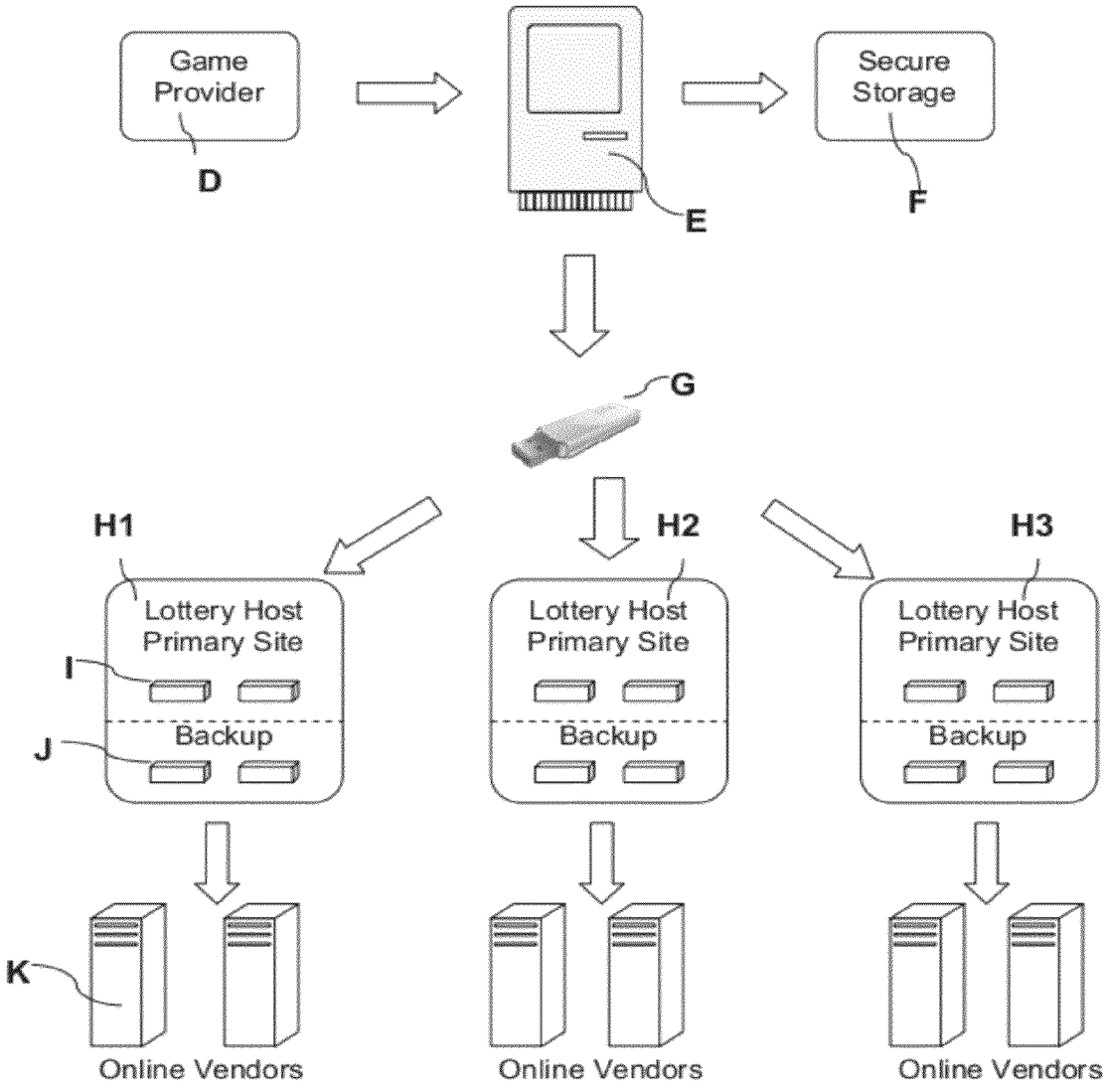
FIG. 5 is a diagram view of a system that may be used for implementing embodiments of the gaming methodology described herein.

Lottery games incorporating the probability management method and percentage payout structure described above may be implemented by various system configurations. FIG. 5 is a block diagram illustrating an exemplary basic system configuration in accordance with principles of the invention. Referring to FIG. 5, a game provider D may design a lottery game and upload the necessary files for conducting the game to a secure server E that is maintained by the game provider.

The files may also be separately stored in a secure storage device F. The game provider may provide to any one or combination of gaming authorities, such as separate states, jurisdictions, and so forth, hardware "black boxes" I for conducting the lottery games. For example, individual gaming authorities represented by lottery host primary sites H1, H2, and H3 in FIG. 5 may be provided with the black boxes I. These boxes I would include file instructions, programs, the first and second decks of records, and any other software necessary for conducting the game and interfacing with the authority's network. A primary set of the boxes I may be provided, as well as a backup set J. At least one set of the black boxes will reside in the gaming authority's primary data center, and these boxes are connected to the gaming authority's network so as to be in communication with individual online vendors K within the gaming authority's jurisdiction.

The lottery game files may be downloaded from the game provider's server E to a storage device G, such as a USB storage device, which is then physically delivered to the individual lottery host primary sires H1, H2, and H3. The game files are transferred from the storage device G to the black boxes I previously provided to the host sites H1, H2, and H3. The online vendor systems K can only communicate with the black boxes I using the game provider's secure protocol and definitions. This communication is necessary to pass a player's selections to the black boxes I, and to receive the results of the online instant play generated by the black boxes I. For audit and reporting purposes, the black boxes I are also configured to run special programs to generate reports of all transactions processed during certain periods of time, and so forth, as requested by the lottery host primary site and/or game provider.

Figure 6:
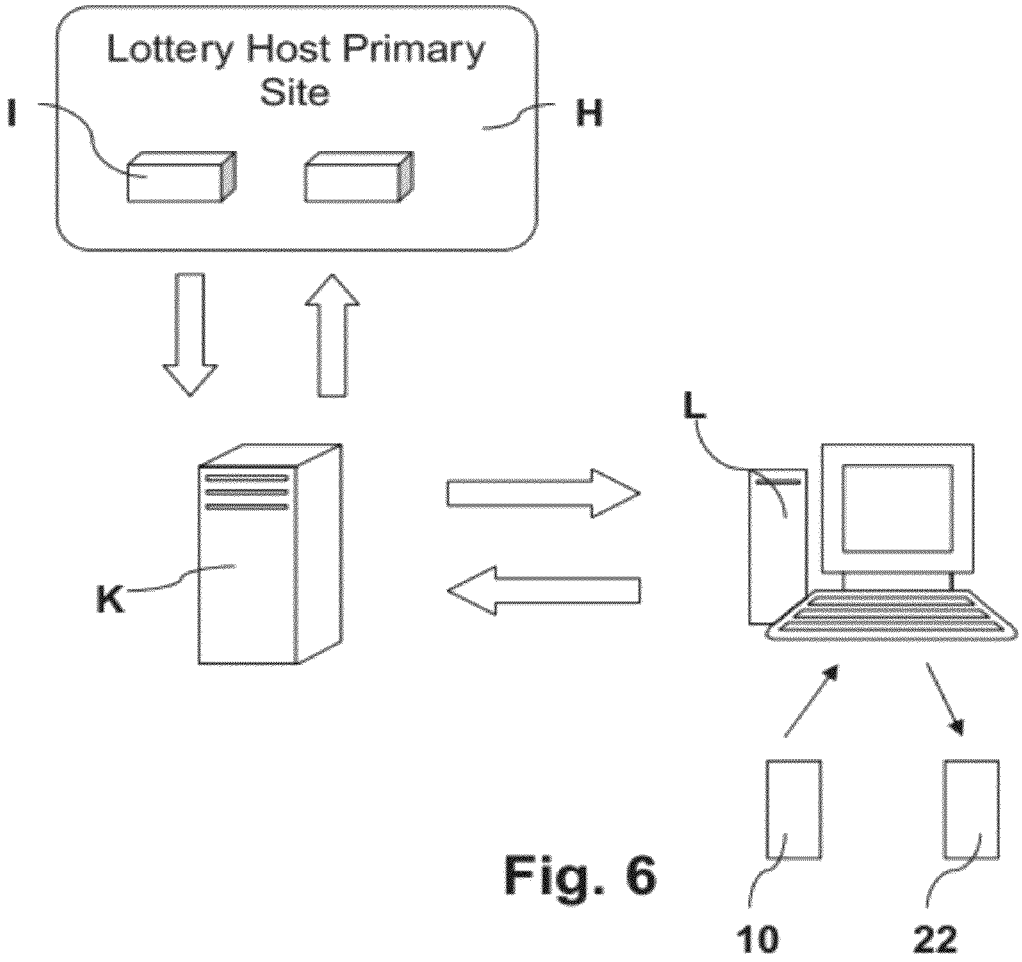
FIG. 6 is a diagram view of system components that may be used for implementing certain embodiments of the gaming methodology described herein.

Referring to FIG. 6, an individual game play is initiated by a player submitting a play slip 10 at a lottery terminal L. The player's selected indicia are transmitted via online vendor's server K to the black boxes I provided to the host H by the game provider. The decks of records discussed above with respect to the probability management and percentage payout methods and systems are contained in the boxes, and for each game play, the boxes I increment the first deck to determine the number X of indicia in the subset of indicia. The subset having the X number of indicia is then randomly generated from the total field of indicia, and the result of the game play is provided to the player via the ticket 22. In the invent that the game play is a winning game play (i.e. the player's selection is contained in the subset of randomly generated indicia), then the black boxes I increment the second deck of records related to the payout percentage system. The payout value associated with the respective record is assigned to the winning game play and indicated on the ticket 22.

Preferably, the set of primary black boxes I are configured so that each of the black boxes functions to implement the game. Thus, in the event that one of the boxes is not available, the second box I in the primary set can perform the exact game functions. The same applies to the backup set of boxes J.

As discussed, an additional game component may be provided with the online lottery game and related to the theme of the online game. Referring to FIG. 1B, a portion 26 of the game ticket 22 provides to the player a randomly generated entry into the additional game, for example a unique raffle number randomly generated at the terminal. These raffle numbers are communicated to the central gaming authority, and all of the assigned raffle numbers are entered into a subsequent drawing. Because only assigned numbers are in the pool of raffle numbers, a winner is guaranteed for each drawing. The area 26 in the ticket indicates to the player the time and manner of drawing the raffle number, as well as the raffle prize, and any other information related to the raffle drawing.

It a particularly unique embodiment, the raffle drawing may be conducted as a portion of an event related to the theme of the lottery game. For example, the lottery theme may relate to a game show, with the raffle being conducted in conjunction with the show, for example by being incorporated into broadcasting of the show by a local affiliate. The local affiliate may coordinate with the gaming authority to draw the raffle number during an intermission in the show, or immediately after the show. In still an alternative embodiment, the gaming authority may conduct the raffle drawing at a later time independent of the show time.

It should also be readily appreciated by those skilled in the art that modifications and variations may be made to the embodiments of the system and methodology described herein without departing from the scope and spirit of the invention.

What is claimed is:

1. A computer-implemented method of conducting a probability-based lottery game with a computer system having instruction files to implement the lottery game as follows:

for each play of the lottery game, providing for a player to choose a number of player indicia from a total field of the indicia, wherein the player indicia is compared to a randomly generated subset of X number of indicia from the total field of the indicia to determine whether the game play is a winning play; and establishing a desired overall winning probability for the game plays by varying the number X of indicia in the subsets between different game plays such that a blend of the winning probabilities for each number X for all of the game plays produces the desired overall winning probability.

2. The method as in claim 1, wherein the number X of indicia in the subsets is less than the number of indicia in the total field, and the number of player indicia is less than the number X of indicia in the subsets.

3. The method as in claim 1, wherein the step of establishing the desired overall winning probability comprises establishing a deck of indicia subset records containing a plurality of sets of records (X1, X2, . . . ) designating a respective number (X1, X2, . . . ) of indicia in the subsets, and wherein the blend of different sets of records having different X numbers is computed to achieve the overall desired winning probability for the game.

4. The method as in claim 3, wherein the records in the first deck are randomly shuffled and assigned sequentially to each game play.

5. The method as in claim 4, wherein the total number of records in the first deck corresponds to the total number of game plays designated for the lottery game.

6. The method as in claim 3, wherein the step of assigning a payout to each winning game play comprises establishing a deck of payout records, with the number of records in the payout deck corresponding to the expected number of winning game plays as a function of the overall winning probability of the game, each of the records in the payout deck designating a prize payout such that a totality of the payouts corresponds to the desired percentage payout schedule, and assigning one of the records in the payout deck to each of the game plays designated as a winning game play.

7. The method as in claim 6, wherein the records in the payout deck are randomly shuffled and assigned sequentially to the winning game plays.

8. The method as in claim 7, wherein the game includes multiple winning game play combinations, and further comprising establishing additional payout decks for each combination, and distributing the prize payout over all of the payout decks so as to achieve the desired percentage payout schedule for all of the possible winning combinations.

9. The method as in claim 1, further comprising assigning a payout to each winning game play as a function of a predefined overall percentage payout for the game and the overall winning probability such that the payout for all expected winning game plays achieves the percentage payout.

10. The method as in claim 1, wherein the probability-based lottery game is conducted as an online lottery game.

* * * * *